US007550422B2

(12) United States Patent
Sgargetta et al.

(10) Patent No.: US 7,550,422 B2
(45) Date of Patent: Jun. 23, 2009

(54) COMPOSITION WITH A METAL-COMPLEXING DYE AND SURFACTANT

(75) Inventors: Giorgia Sgargetta, Cannara (IT); Stacie Ellen Hecht, West Chester, OH (US); Jichun Shi, Liberty Township, OH (US); Mark Robert Sivik, Mason, OH (US); Donald Leroy Wilke, Mason, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 518 days.

(21) Appl. No.: 11/242,766

(22) Filed: Oct. 4, 2005

(65) Prior Publication Data

US 2006/0073999 A1 Apr. 6, 2006

Related U.S. Application Data

(60) Provisional application No. 60/615,839, filed on Oct. 4, 2004.

(51) Int. Cl.
*C11D 17/00* (2006.01)

(52) U.S. Cl. ..... 510/343; 510/100; 510/108; 510/218; 510/220; 510/373; 510/419; 510/422; 510/461; 510/470; 510/499

(58) Field of Classification Search ..... 510/424–426, 510/100, 108, 218, 220, 343, 373, 419, 422, 510/461, 470, 499
See application file for complete search history.

(56) References Cited

U.S. PATENT DOCUMENTS

| | | | | |
|---|---|---|---|---|
| 3,214,454 | A | 10/1965 | Blaser et al. | |
| 3,650,831 | A | 3/1972 | Jungermann et al. | |
| 5,350,694 | A * | 9/1994 | Zimmerle | 436/2 |
| 5,929,004 | A | 7/1999 | Ushijima et al. | |
| 6,331,515 | B1 * | 12/2001 | Gambogi et al. | 510/424 |
| 2003/0130153 | A1 * | 7/2003 | Foley et al. | 510/421 |

FOREIGN PATENT DOCUMENTS

| | | | |
|---|---|---|---|
| EP | 0 255 978 | A2 | 2/1988 |
| EP | 0 369 500 | A2 | 5/1990 |
| GB | 1313180 | | 4/1973 |
| WO | WO99/60089 | * | 11/1999 |
| WO | WO 03/014282 | A1 | 2/2003 |

OTHER PUBLICATIONS

Sigma-Aldrich structural database: http://www.sigmaaldrich.com/catalog/search/ProductDetail/FLUKA/64000, 2007.*
PCT International Search Report, 4 Pages, Mailed Jan. 10, 2006.

* cited by examiner

*Primary Examiner*—Lorna M Douyon
*Assistant Examiner*—Tri V Nguyen
(74) *Attorney, Agent, or Firm*—Laura R. Grunzinger; Idris N. McKelvey

(57) ABSTRACT

The present invention relates to a composition with a metal-complexing dye and surfactant for giving a color change when in contact with selected metal ions.

11 Claims, No Drawings

COMPOSITION WITH A METAL-COMPLEXING DYE AND SURFACTANT

CROSS-REFERENCED APPLICATIONS

This application claims priority under 35 U.S.C. § 119(e) to U.S. provisional application No. 60/615839, filed Oct. 4, 2004.

TECHNICAL FIELD

The present invention relates to a composition for cleaning or rinsing purposes having a metal-complexing dye and a surfactant that gives a visual indication upon dilution in a volume of water.

BACKGROUND TO THE INVENTION

Cleaning solutions used where items, such as dishes or clothing, are washed or rinsed in a standing volume of water accumulates soils from the items and often results in a reddish-brown hue after several items are washed or rinsed. The perception is that such reddish-brown water is "dirty" and unfit for further use. Conventional dyes have been in an attempt to mask such reddish-brown water, but this has lead to less than acceptable results for consumers and impacting on other aesthetic aspects of the cleaning product.

Chelating agents have been used in cleaning products. However these types of chelating agents do not impact the aesthetic aspect of the color of the washing or rinsing volume of water utilized and these types of chelating agents do not change color upon complexation. Rather known chelating agents remove ions from the volume of water that impact the cleaning of the cleaning product. Therefore there exists a need to have a cleaning product having acceptable aesthetic aspects that is able to mask the reddish-brown water color after items are washed or rinsed in a standing volume of water.

SUMMARY OF THE INVENTION

The present invention relates to a composition comprising an effective metal-complexing dye in an uncomplexed form and from about 0.1 wt % to about 40 wt % of a surfactant.

The present invention further relates to the use of a composition comprising a metal-complexing dye and a surfactant to give a visual indication upon dilution in a volume of water having an effective amount of metal ion.

The present invention further relates to the use of a composition comprising a metal-complexing dye and a surfactant to mask the color of soil in a volume of water.

The present invention further relates to the use of a composition comprising a metal-complexing dye and a surfactant to enhance the color of suds.

DETAILED DESCRIPTION OF THE INVENTION

As used herein "liquid dishwashing detergent composition" refers to those compositions that are employed in manual (i.e., hand) dishwashing and any solutions containing the composition in a diluted form. Such compositions are generally high sudsing or foaming in nature.

As used herein "laundry detergent composition" refers to those compositions that are employed in washing clothing and other fabrics and any solutions containing the composition in a diluted form. Such compositions are generally low sudsing or foaming in nature.

As used herein "volume of water" refers to a volume of water that is sufficient for rinsing or washing actions in a container such as a bucket or sink, that volume being from about 2000 ml. to about 20000 ml., more typically from about 5000 ml. to about 15000 ml. of water in a container such as a bucket or sink having a volumetric capacity in the range of from about 1000 ml. to about 20000 ml., more typically from about 5000 ml. to about 15000 ml. The water may be from any water source, for example any municipal, commercial, household or other available water sources.

Incorporated and included herein, as if expressly written herein, are all ranges of numbers when written in a "from X to Y" or "from about X to about Y" format. It should be understood that every limit given throughout this specification will include every lower or higher limit, as the case may be, as if such lower or higher limit was expressly written herein. Every range given throughout this specification will include every narrower range that falls within such broader range, as if such narrower ranges were all expressly written herein.

Unless otherwise indicated, weight percentage is in reference to weight percentage of the detergent composition. All temperatures, unless otherwise indicated are in Celsius. All documents cited are, in relevant part, incorporated herein by reference.

The compositions of the present composition are preferably suitable for use in cleaning hard surfaces, for example any kind of surfaces typically found in houses like kitchens, bathrooms, or in car interiors or exteriors, e.g., floors, walls, tiles, windows, sinks, showers, shower plastified curtains, wash basins, WCs, dishes, fixtures and fittings and the like made of different materials like ceramic, vinyl, no-wax vinyl, linoleum, melamine, glass, any plastics, plastified wood, metal or any painted or varnished or sealed surface and the like. Hard-surfaces also include household appliances including, but not limited to, refrigerators, freezers, washing machines, automatic dryers, ovens, microwave ovens, dishwashers and so on.

In one preferred embodiment the composition is suitable for cleaning dishware including dishes, cups, cutlery, glassware, food storage containers, cutlery, cooking utensils, sinks and other kitchen surfaces. In another preferred embodiment the composition is suitable for cleaning fabrics including clothing, towels, sheets, drapery, rugs, and other cloth items.

The composition may be in any suitable form, for example a solid form like powders, granules, tablets, capsules or combinations of any of these forms. Or, for example, a liquid or semi-liquid form like gels, liquids or a unit dose form such as tablets, capsules or combinations of any of these forms. In one embodiment the composition is in liquid form. In another embodiment the composition is in a liquid aqueous form.

Metal-Complexing Dye

The composition of the present composition comprises an effective amount of a metal-complexing dye in an uncomplexed form, preferably from 0.001% to 0.5%, such as from 0.01% to 0.2%, further from 0.01% to 0.1% by weight of the composition. As used herein "uncomplexed" means that the metal-complexing dye has not interacted with a metal ion to give a visual indication. The metal-complexing dye should be selected to complex with alkaline earth metal ions, rare earth metal ions, transition metal ions and mixtures thereof. Preferably the metal-complexing dye is selected to complex with calcium, magnesium or iron ions as these are commonly found in water available to users of the composition.

The metal-complexing dye should be compatible in a composition and maintain a transparent visual appearance in the composition without interfering with traditional dyes in a composition. As used herein "compatible" means that the metal-complexing dye does not have a negative impact upon aesthetic or functional aspects of the composition. For example, the metal-complexing dye should not crash (precipitate) out of formulation or cause phase separation of the composition, nor should it destroy or interfere with the other components of the composition in their intended functions.

When the composition is added to a volume of water, the composition should give a visual indication when the metal complexing dye complexes with a metal ion, preferably a metal ion present in the volume of water. The color change is preferably characterized by a solution absorption wavelength of $\lambda$max=500 to 650 nm, and more preferably 545 to 650 nm. Without being limited by a theory, it is believed that these wavelengths, which correspond to the visual appearance of blue and green colors for the solution, indicate to users of the composition that the volume of water is "clean" by masking the color of soil in the volume of water such that the volume of water with the composition may still be utilized to wash or rinse items being cleaned or rinsed. Such a visual indication may also be used to enhance the color of suds to present a whiter, more attractive appearance to the suds.

The metal-complexing dye may be selected from one or more of the Formulas A-I exemplified below.

Formula A

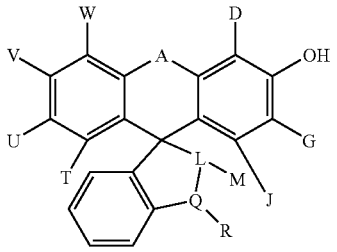

Wherein A is selected from two hydrogens on the respective ring structures or O (oxygen). D is selected from hydrogen, methyl (—$CH_3$) or —$CH(CH_3)_2$. G is selected from —$CH_2N(CH_2COOH)_2$ or —OH. J is selected from hydrogen or methyl (—$CH_3$). -L-M is O (oxygen). Q-R is a —C═O (carbon double bonded to oxygen) or —$SO_2$ moiety. T is selected from hydrogen or methyl (—$CH_3$). U is selected from —$CH_2N(CH_2COOH)_2$ or —OH. V is selected as —OH. W is selected from hydrogen, methyl (—$CH_3$) or $CH(CH_3)_2$. Included in Formula A is the metal-complexing dye of TPC and salts thereof, methylthymol blue, cresol phthalexone and salts thereof, calcein, 1,2-benzendiol and caplus.

Formula B

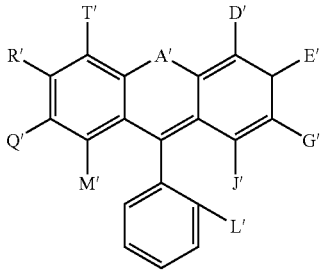

Where A' is selected from two hydrogens on the respective ring structures or O (oxygen). D' is selected from —OH, methyl (—$CH_3$) or —$CH(CH_3)_2$. E' is a ═O (double bonded). G' is selected from hydrogen or —$CH_2N(CH_2COOH)_2$. J' is selected from hydrogen or methyl (—$CH_3$). L' is selected from —$SO_3^-$. M' is selected from hydrogen or methyl (—$CH_3$). Q' is selected from hydrogen or —$CH_2N(CH_2COOH)_2$. R' is —OH. T' is selected from —OH, methyl (—$CH_3$) or —$CH(CH_3)_2$. Included in Formula B is the metal-complexing dye of MXB and salts thereof, MTB and salts thereof and pyrogallol sulfophthalein.

Formula C

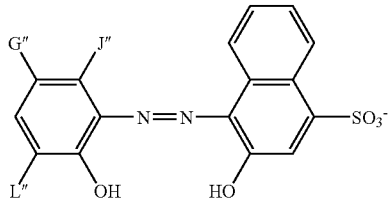

Wherein L" is selected from hydrogen, —COOH, or $SO_3^-$. G"+J" is selected from

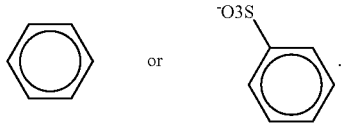

Included in Formula C is the metal-complexing dye of Calcon, Calcon carboxylic acid and hydroxynaphthol blue.

Formula D

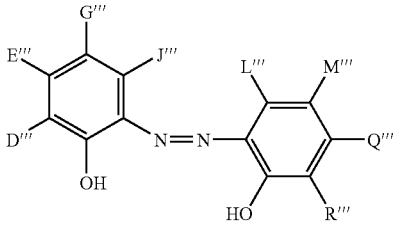

Wherein D''' and E''' are selected from hydrogen or are selected such that together they form

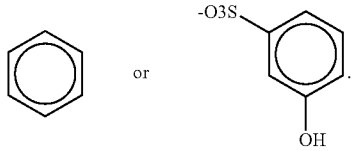

G'''is hydrogen. J''' is selected from hydrogen or —$SO_3^-$. L''' and M''' are selected from hydrogen or combined together (L'''+M''') and selected from

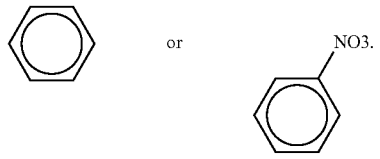

Q''' is selected from hydrogen or —$SO_3^-$. R''' is selected from hydrogen and

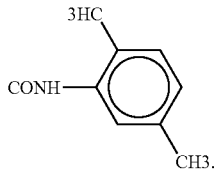

Included in Formula D is the metal-complexing dye of eriochrome blue SE, eriochrome black T, eriochrome blue-black B, or xylidyl blue.

Formula E

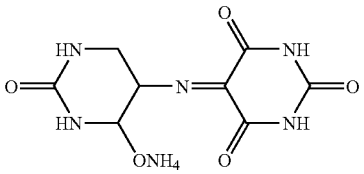

Strucutre E is the metal-complexing dye of Murexide.

Formula F

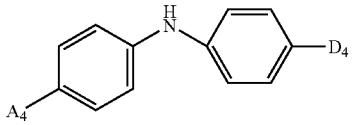

Wherein $A_4$ is selected from —$OCH_3$ and $D_4$ is —$NH_2$. Formula F is the metal-complexing dye of 1,4-Benzenediamine.

Formula G

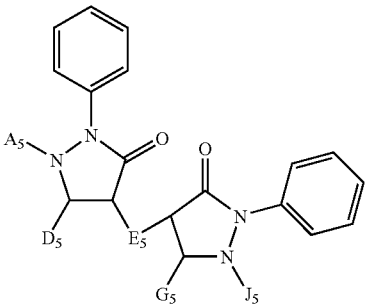

Wherein $A_5$, $D_5$, $J_5$ and $G_5$ are methyl (—$CH_3$) and $E_5$ is a —$CH_2$— moiety. Formula G is the metal-complexing dye of diantipyrylmethane.

Formula H

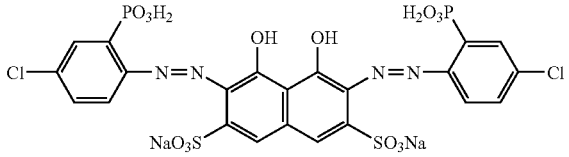

Formula H is the metal-complexing dye of chlorophosphonoazo-III.

Formula I

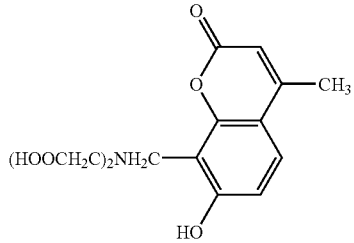

Formula I is the metal-complexing dye of calcein blue.

The various metal-complexing dyes are available from suppliers such as Merck KgaA Analytical & Reagents, Dojindo Molecular Technologies Inc., and Lancaster Synthesis, among others.

Fluorescent Dye

A fluorescent co-dye can further enhance the visual indication of the present composition. For example Calcein at alkaline conditions is not fluorescent while upon complexation with calcium and/or magnesium ions emits fluorescence. Calcein Blue emits a blue fluorescence at pH 4-11 and no fluorescence at pH 12. Fluorescence is also quenched by the presence of metal ions such as Co, Cu, Mn, Ni, Pb and at a lesser extent by Fe and Al (4).

Optional Ingredients

The compositions of the present composition may also comprise optional ingredients for example surfactant, hydrotrope, viscosity modifier, diamine, surfactants, polymeric suds stabilizer, enzymes, builder, perfume, chelating agent and mixtures thereof. The type or form of the composition, whether it is a liquid dishwashing detergent composition, a hard surface cleaning composition, a rinse added composition, a laundry detergent composition, among others, will dictate the appropriate type of optional ingredients. One of skill in the art is able to select the appropriate optional ingredients for the composition herein.

Surfactant

The detergent compositions of the present composition may comprise a surfactant. Surfactants may be selected from the group consisting of amphoteric, zwitterionic, nonionic, anionic, cationic surfactants and mixtures thereof. Suitable such surfactants are those commonly used in detergent compositions. The surfactant may be present from about 0.1 wt % to about 40 wt %.

Amphoteric Surfactants

Amphoteric surfactants that may be useful in the present composition are selected from amine oxide surfactants. Amine oxides are semi-polar nonionic surfactants and include water-soluble amine oxides containing one alkyl moiety from about 10 to about 18 carbon atoms and 2 moieties selected from the group consisting of alkyl groups and hydroxyalkyl groups containing from 1 to 3 carbon atoms; water-soluble phosphine oxides containing one alkyl moiety from 10 to 18 carbon atoms and 2 moieties selected from the group consisting of alkyl groups and hydroxyalkyl groups containing from about 1 to about 3 carbon atoms; and water-soluble sulfoxides containing one alkyl moiety from about 10 to about 18 carbon atoms and a moiety selected from the group consisting of alkyl and hydroxyalkyl group of from 1 to 3 carbon atoms. Preferred amine oxide surfactants in particular include $C_{10}$-$C_{18}$ alkyl dimethyl amine oxides and $C_8$-$C_{12}$ alkoxy ethyl dihydroxy ethyl amine oxides.

Other suitable, non-limiting examples of amphoteric detergent surfactants that are useful in the present composition include amido propyl betaines and derivatives of aliphatic or heterocyclic secondary and ternary amines in which the aliphatic moiety can be straight chain or branched and wherein one of the aliphatic substituents contains from 8 to 24 carbon atoms and at least one aliphatic substituent contains an anionic water-solubilizing group.

The amphoteric surfactant, when present, is present in the composition in an effective amount such as from about 0.1% to about 40%, further such as about 0.1% to about 20%, even further such as about 0.5% to about 15% by weight of the composition.

Nonionic Surfactants

Nonionic surfactants which may be included are the condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 18 moles of ethylene oxide per mole of alcohol.

Also included are alkylpolyglycosides that may have the formula (II) $R^2O(C_nH_{2n}O)_t(\text{glycosyl})_x$ (II), wherein $R^2$ of formula (II) is selected from the group consisting of alkyl, alkyl-phenyl, hydroxyalkyl, hydroxyalkylphenyl, and mixtures thereof in which the alkyl groups contain from about 10 to about 18, further from about 12 to about 14 carbon atoms; n of formula (II) is 2 or 3, further 2; t of formula (II) is from 0 to about 10, further 0; and x of formula (II) is from about 1.3 to about 10, further from about 1.3 to about 3, more further from about 1.3 to about 2.7. The glycosyl is preferably derived from glucose. To prepare these compounds, the alcohol or alkylpolyethyl alcohol is formed first and then reacted with glucose, or a source of glucose, to form the glucoside (attachment at the 1-position). The additional glycosyl units can then be attached between their 1-position and the preceding glycosyl units 2-, 3-, 4- and/or 6-position, preferably predominantly the 2-position.

Further nonionic surfactants that may be include are fatty acid amide surfactants having the formula (III):

formula (III)

$$R^6\overset{\overset{\displaystyle O}{\|}}{C}N(R^7)_2$$

wherein $R^6$ of formula (III) is an alkyl group containing from about 7 to about 21 (preferably from about 9 to about 17) carbon atoms and each $R^7$ formula (III) is selected from the group consisting of hydrogen, $C_1$-$C_4$ alkyl, $C_1$-$C_4$ hydroxyalkyl, and —$(C_2H_4)_xH$ where x formula (III) varies from 1 to 3. Preferred amides are $C_8$-$C_{20}$ ammonia amides, monoethanolamides, diethanolamides, and isopropanolamides.

The nonionic surfactant, when present in the composition, is present in an effective amount, such as from about 0.1% to about 40%, further from about 0.1% to about 20%, even further from about 0.5% to about 15%, by weight of the composition.

Anionic Surfactants

Anionic surfactants when utilized as components of the compositions of the present application may be suitable anionic surfactants for selected from water-soluble salts or acids of $C_6$-$C_{20}$ linear or branched hydrocarbyl, such as an alkyl, hydroxyalkyl or alkylaryl, having a $C_{10}$-$C_{20}$ hydrocarbyl component, more preferably a $C_{10}$-$C_{14}$ alkyl or hydroxyalkyl, sulphate or sulphonates. Suitable counterions include hydrogen, alkali metal cation or ammonium or substituted ammonium, further sodium. When branched, the hydrocarbyl branch may be selected from one or more $C_1$-$C_4$ alkyl branches. The average percentage branching of the anionic surfactant is preferably greater than 30 wt %, more preferably from 35 wt % to 80 wt % and most preferably from 40 wt % to 60 wt % by weight of the anionic surfactant.

The anionic surfactant, when present, is at a level of at least 15%, such as from 20% to 40% and further from 25% to 40% by weight of the composition.

Cationic Surfactants/Fabric Softening Additives

Cationic surfactants when utilized as components of the composition of the present application may be selected from non quaternary ammonium surfactants which can have up to 26 carbon atoms that include, but are not limited to alkoxylate quaternary ammonium (AQA) surfactants as discussed in U.S. Pat. No. 6,136,769; dimethyl hydroxyethyl quaternary ammonium as discussed in U.S. Pat. No. 6,004,922; polyamine cationic surfactants as discussed in WO 98/35002, WO 98/35003, WO 98/35004, WO 98/35005, and WO 98/35006; cationic ester surfactants as discussed in U.S. Pat. Nos. 4,228,042, 4,239,660 4,260,529 and U.S. 6,022,844; and amino surfactants as discussed in U.S. Pat. No. 6,221,825 and WO 00/47708, specifically amido propyldimethyl amine.

Suitable cationic surfactants may also be selected from selected from known fabric softening additive including, but not limited to ditallowoyloxyethyl dimethyl ammonium chloride, dihydrogenated-tallowoyloxyethyl dimethyl ammonium chloride, dicanola-oyloxyethyl dimethyl ammonium chloride, ditallow dimethyl ammonium chloride, tritallow methyl ammonium chloride, methyl bis(tallow amidoethyl) 2-hydroxyethyl ammonium methyl sulfate, methyl bis(hydrogenated tallow amidoethyl)-2-hydroxyethyl ammonim methyl sulfate, methyl bis(oleyl amidoethyl)-2-hydroxyethyl ammonium methyl sulfate, ditallowoyloxyethyl dimethyl ammonium methyl sulfate, dihydrogenated-tallowoyloxyethyl dimethyl ammonium chloride, dicanola-oyloxyethyl dimethyl ammonium chloride, N-tallowoyloxyethyl-N-tallowoylaminopropyl methyl amine, 1,2-bis(hardened tallowoyloxy)-3-trimethylammonium propane chloride, and mixtures thereof.

Polyquaternary ammonium compounds can also be useful as cationic surfactants in the present compositions and are described in more detail in the following patent documents: EP 803,498; GB 808,265; GB 1,161,552; DE 4,203,489; EP 221,855; EP 503,155; EP 507,003; EP 803,498; FR 2,523,606; JP 84-273918; JP 2-011,545; U.S. Pat. Nos. 3,079,436; 4,418,054; 4,721,512; 4,728,337; 4,906,413; 5,194,667; 5,235,082; 5,670,472; Weirong Miao, Wei Hou, Lie Chen, and Zongshi Li, *Studies on Multifunctional Finishing Agents,* Riyong Huaxue Gonye, No. 2, pp. 8-10, 1992; Yokagaku, Vol. 41, No. 4 (1992); and Disinfection, Sterilization, and Preservation, 4th Edition, published 1991 by Lea & Febiger, Chapter 13, pp. 226-30. The products formed by quaternization of reaction products of fatty acid with N,N,N',N', tetraakis(hydroxyethyl)-1,6-diaminohexane are also suitable for use in the present invention.

Cationic starch based on common maize starch or potato starch, containing 25% to 95% amylose and a degree of substitution of from 0.02 to 0.09, such as that vailable from Cerestar under the trade name C*BOND® and National Starch under the trade name CATO® A2 may also be utilized as cationic surfactants/fabric softening additives. Also cationic phophorylated starch such as that discussed in U.S. Pat. No. 4,876,336 (Table II, samples A and F) and in US 2005/0054553.

Examples of ester and/or amide linked cationic surfactants useful in the present compositions, are disclosed in U.S. Pat. Nos. 5,759,990 and 5,747,443. Examples of suitable amine softeners that can be used in the present composition as cationic surfactants are disclosed in U.S. Pat. No. 6,630,441. Other fabric softening actives that can be used herein are disclosed, at least generically for the basic structures, in U.S. Pat. Nos. 3,861,870; 4,308,151; 3,886,075; 4,233,164; 4,401,578; 3,974,076; and 4,237,016. Examples of more biodegradable cationic surfactants can be found in U.S. Pat. Nos. 3,408,361; 4,709,045; 4,233,451; 4,127,489; 3,689,424; 4,128,485; 4,161,604; 4,189,593; and 4,339,391.

The cationic surfactant, when present in the composition, is present in an effective amount, such as from about 0.1% to about 40%, further from about 1% to about 27%, even further from about 5% to about 20%, by weight of the composition.

Aqueous Liquid Carrier

The compositions herein when in liquid form may further contain from about 30% to 80% of an aqueous liquid carrier in which the other essential and optional components are dissolved, dispersed or suspended. More preferably the aqueous liquid carrier will comprise from about 45% to about 70%, such as from about 45% to about 65% of the compositions herein.

One preferred component of the aqueous liquid carrier is water. The aqueous liquid carrier, however, may contain other components which are liquid, or which dissolve in the liquid carrier, at room temperature (20° C.-25° C.) and which may also serve some other function besides that of an inert filler. Such materials can include, for example, hydrotropes and solvents, discussed in more detail below. Dependent on the geography of use of the composition herein, the water in the aqueous liquid carrier can have a hardness level of about 2-30 gpg ("gpg" is a measure of water hardness that is well known to those skilled in the art, and it stands for "grains per gallon").

pH of the Composition when in Liquid Form

The composition herein may have any suitable pH. Preferably the pH of the composition is adjusted to between 4 and 14. More preferably the composition has pH of between 6 and 13, most preferably between 6 and 10. The pH of the composition can be adjusted using pH modifying ingredients known in the art.

Thickness of the Composition

The compositions herein when embodied in a liquid form may be thickened and have viscosity of greater than 700 cps, when measured at 20° C., such as between 700 and 1100 cps. The present composition excludes compositions which are in the form of microemulsions.

Solvent

The compositions herein may optionally comprise a solvent. Suitable solvents include $C_{4-14}$ ethers and diethers, glycols, alkoxylated glycols, $C_6$-$C_{16}$ glycol ethers, alkoxylated aromatic alcohols, aromatic alcohols, aliphatic branched alcohols, alkoxylated aliphatic branched alcohols, alkoxylated linear $C_1$-$C_5$ alcohols, linear $C_1$-$C_5$ alcohols, amines, $C_8$-$C_{14}$ alkyl and cycloalkyl hydrocarbons and halohydrocarbons, and mixtures thereof. When branches are present, there may be one or more $C_1$-$C_4$ branches.

Preferred solvents are selected from methoxy octadecanol, ethoxyethoxyethanol, benzyl alcohol, 2-ethylbutanol and/or 2-methylbutanol, 1-methylpropoxyethanol and/or 2-methylbutoxyethanol, linear $C_1$-$C_5$ alcohols such as methanol, ethanol, propanol, isopropanol, butyl diglycol ether (BDGE), butyltriglycol ether, tert-amyl alcohol, glycerol and mixtures thereof. Particularly preferred solvents which can be used herein are butoxy propoxy propanol, butyl diglycol ether, benzyl alcohol, butoxypropanol, propylene glycol, glycerol, ethanol, methanol, isopropanol and mixtures thereof.

Other suitable solvents for use herein include propylene glycol derivatives such as n-butoxypropanol or n-butoxypropoxypropanol, water-soluble CARBITOL R® solvents or water-soluble CELLOSOLVE R® solvents. Water-soluble CARBITOL R® solvents are compounds of the 2-(2-alkoxyethoxy)ethanol class wherein the alkoxy group is derived from ethyl, propyl or butyl; a preferred water-soluble CARBITOL® is 2-(2-butoxyethoxy)ethanol, also known as BUTYL CARBITOL®. Water-soluble CELLOSOLVE R® solvents are compounds of the 2-alkoxyethoxy ethanol class, with 2-butoxyethoxyethanol being preferred. Other suitable solvents include benzyl alcohol, and diols such as 2-ethyl-1,3-hexanediol and 2,2,4-trimethyl-1,3-pentanediol and mixtures thereof. Some preferred solvents for use herein are n-butoxypropoxypropanol, 2-(2-butoxyethoxy)ethanol and mixtures thereof.

The solvents can also be selected from the group of compounds comprising ether derivatives of mono-, di- and triethylene glycol, butylene glycol ethers, and mixtures thereof. The weight average molecular weights of these solvents are preferably less than 350, such as between 100 and 300, further such as between 115 and 250. Examples of preferred solvents include, for example, mono-ethylene glycol n-hexyl ether, mono-propylene glycol n-butyl ether, and tri-propylene glycol methyl ether. Ethylene glycol and propylene glycol ethers are commercially available from the Dow Chemical Company under the tradename DOWANOL® and from the Arco Chemical Company under the tradename ARCOSOLV®. Other preferred solvents including mono- and di-ethylene glycol n-hexyl ether are available from the Union Carbide Corporation.

When present, the compositions herein will contain 0.01%-20%, such as 0.5%-20%, further 1%-10% by weight of the composition of a solvent. The solvents may be used in conjunction with an aqueous liquid carrier, such as water, or they may be used without any aqueous liquid carrier being present.

Hydrotrope

The compositions herein may optionally comprise a hydrotrope in an effective amount so that the compositions are appropriately compatible in water. By "appropriately compatible in water", it is meant that the product dissolves quickly enough in water as dictated by both the washing habit and conditions of use. Compositions that do not dissolve quickly in water can lead to negatives in performance regarding overall cleaning, sudsing, and ease of rinsing of the composition from surfaces such as dishes/glasses etc. or compositions remaining on surfaces after washing. Inclusion of hydrotropes also serves to improve composition stability and formulatibility as is well known in the literature and prior art.

Suitable hydrotropes for use herein include anionic-type hydrotropes, particularly sodium, potassium, and ammonium xylene sulfonate, sodium, potassium and ammonium toluene sulfonate, sodium potassium and ammonium cumene sulfonate, and mixtures thereof, and related compounds, as disclosed in U.S. Pat. No. 3,915,903.

The compositions herein typically comprise from 0% to 15% by weight of the composition of a hydrotropic, or mixtures thereof, preferably from 1% to 10%, most preferably from 3% to 6% by weight of the composition.

Hydrophobic Block Polymer

The compositions herein may optionally comprise a hydrophobic block polymer having alkylene oxide moieties and a weight average molecular weight of at least 500, but preferably less than 10,000, such as from 1000 to 5000 and further from 1500 to 3500. Suitable hydrophobic polymers have a water solubility of less than about 1%, such as less than about 0.5%, further less than about 0.1% by weight of the polymer at 25° C.

"Block polymers" as used herein is meant to encompass polymers including two or more different homopolymeric and/or monomeric units which are linked to form a single polymer structure. Preferred copolymers comprise ethylene oxide as one of the monomeric units. More preferred copolymers are those with ethylene oxide and propylene oxide. The ethylene oxide content of such preferred polymers is more than about 5 wt %, and more preferably more than about 8 wt %, but less than about 50 wt %, and more preferably less than about 40 wt %. A preferred polymer is ethylene oxide/propylene oxide copolymer available from BASF under the tradename PLURONIC L81®, PLURONIC L35® or PLURONIC L43®.

The compositions herein optionally comprise from 0% to 15% by weight of the composition of one or more hydrophobic block polymer(s), preferably from 1% to 10%, most preferably from 1% to 6% by weight of the composition.

Thickening Agent

The compositions herein can also contain from about 0.2% to 5% by weight of the detergent composition of a thickening agent. More preferably, such a thickening agent will comprise from about 0.5% to 2.5% of the detergent compositions herein. Thickening agents are typically selected from the class of cellulose derivatives. Suitable thickeners include hydroxy ethyl cellulose, hydroxyethyl methyl cellulose, carboxy methyl cellulose, cationic hydrophobically modified hydroxyethyl cellulose, available from Amerchol Corporation as QUATRISOFT® LM200, and the like. A preferred thickening agent is hydroxypropyl methylcellulose.

Polymeric Suds Stabilizer

The compositions herein may optionally contain a polymeric suds stabilizer. These polymeric suds stabilizers provide extended suds volume and suds duration of the compositions. These polymeric suds stabilizers may be selected from homopolymers of (N,N-dialkylamino) alkyl esters and (N,N-dialkylamino) alkyl acrylate esters. The weight average molecular weight of the polymeric suds boosters, determined via conventional gel permeation chromatography, is from 1,000 to 2,000,000, such as from 5,000 to 1,000,000, further from 10,000 to 750,000, further still from 20,000 to 500,000, even further from 35,000 to 200,000. The polymeric suds stabilizer can optionally be present in the form of a salt, either an inorganic or organic salt, for example the citrate, sulfate, or nitrate salt of (N,N-dimethylamino)alkyl acrylate ester.

One preferred polymeric suds stabilizer is (N,N-dimethylamino)alkyl acrylate esters, namely the acrylate ester represented by the formula (IV):

(IV)

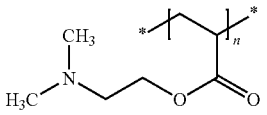

When present in the composition, the polymeric suds booster may be present in the composition from 0.01% to 15%, such as from 0.05% to 10%, further from 0.1% to 5%, by weight of the composition. n of formula (IV) is selected to fall within the desired weight average molecular weight from 1,000 to 2,000,000.

Diamines

Another optional ingredient of the compositions herein is a diamine. Since the habits and practices of the users of compositions such as liquid dishwashing detergent compositions show considerable variation, the composition may contain 0%-15%, such as 0.1%-15%, further 0.2%-10%, further such as 0.25%-6%, also 0.5%-1.5% by weight of said composition of at least one diamine.

Preferred organic diamines include 1,3-bis(methylamine)-cyclohexane (pKa=10 to 10.5), 1,3 propane diamine (pK1=10.5; pK2=8.8), 1,6 hexane diamine (pK1=11; pK2=10), 1,3 pentane diamine (DYTEK EP®) (pK1=10.5; pK2=8.9), 2-methyl 1,5 pentane diamine (DYTEK A®) (pK1=11.2; pK2=10.0). Other preferred materials include primary/primary diamines with alkylene spacers ranging from $C_4$ to $C_8$. In general, it is believed that primary diamines are preferred over secondary and tertiary diamines. As a working definition herein, the pKa of the diamines is specified in an all-aqueous solution at 25° C. and for an ionic strength between 0.1 to 0.5 M.

Preferably, the compositions herein when in liquid form are formulated as clear liquid compositions. By "clear" it is meant stable and transparent. In order to achieve clear compositions, the use of solvents and hydrotropes is well known to those familiar with the art of detergent compositions. Preferred compositions herein are clear single phase liquids, but also embraces clear and opaque products containing dispersed phases, such as beads or pearls as described in U.S. Pat. No. 5,866,529, to Erilli, et al., and U.S. Pat. No. 6,380,150, to Toussaint, et al., provided that such products are physically stable (i.e., do not separate) on storage.

The compositions herein may be packages in any suitable packaging for delivering the composition for use. Preferably the package is a clear package made of glass or plastic.

Builder

The compositions according to the present application may further comprise a builder system. If it is desirable to use a builder, then any conventional builder system is suitable for use herein including aluminosilicate materials, silicates, polycarboxylates and fatty acids, materials such as ethylenediamine tetraacetate, metal ion sequestrants such as aminopolyphosphonates, particularly ethylenediamine tetramethylene phosphonic acid and diethylene triamine pentamethylene-phosphonic acid. Though less preferred for obvious environmental reasons, phosphate builders can also be used herein.

Suitable polycarboxylates builders for use herein include citric acid, preferably in the form of a water-soluble salt, derivatives of succinic acid of the formula (V) R—CH(COOH)$CH_2$(COOH) (formula V) wherein R of formula (V) is $C_{10-20}$ alkyl or alkenyl, such as $C_{12-16}$, or wherein R of formula (V) can be substituted with hydroxyl, sulfo sulfoxyl or sulfone substituents. Specific examples include lauryl succinate, myristyl succinate, palmityl succinate 2-dodecenylsuccinate, 2-tetradecenyl succinate. Succinate builders are preferably used in the form of their water-soluble salts, including sodium, potassium, ammonium and alkanolammonium salts.

Other suitable polycarboxylates are oxodisuccinates and mixtures of tartrate monosuccinic and tartrate disuccinic acid such as described in U.S. Pat. No. 4,663,071.

Especially for the liquid form herein, suitable fatty acid builders for use herein are saturated or unsaturated $C_{10-18}$ fatty acids, as well as the corresponding soaps. Preferred saturated species have from 12 to 16 carbon atoms in the alkyl chain. The preferred unsaturated fatty acid is oleic acid. Other preferred builder system for liquid compositions is based on dodecenyl succinic acid and citric acid.

If builder is included, it may be included in amounts of from 0.5% to 50% by weight of the composition preferably from 0.5% to 25% and most usually from 0.5% to 5% by weight.

Enzymes

The compositions of the present application may further comprise one or more enzymes which provide cleaning performance benefits. Said enzymes include enzymes selected from cellulases, hemicellulases, peroxidases, proteases, gluco-amylases, amylases, lipases, cutinases, pectinases, xylanases, reductases, oxidases, phenoloxidases, lipoxygenases, ligninases, pullulanases, tannases, pentosanases, malanases, β-glucanases, arabinosidases or mixtures thereof. A preferred combination is a composition having a cocktail of conventional applicable enzymes like protease, amylase, lipase, cutinase and/or cellulase. Enzymes when present in the compositions, at from 0.0001% to 5% of active enzyme by weight of the composition. Preferred proteolytic enzymes, then, are selected from the group consisting of ALCALASE® (Novo Industri A/S), BPN', Protease A and Protease B (Genencor), and mixtures thereof. Protease B is most preferred. Preferred amylase enzymes include TERMAMYL®, DURAMYL® and the amylase enzymes those described in WO 9418314 to Genencor International and WO 9402597 to Novo.

Chelating Agents

The compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates. However, these chelating agents are distinguished from the metal complexing dyes described above in that the chelating agents do not undergo a color change upon chelation with the iron and/or manganese ions.

Amino carboxylates useful as optional chelating agents include ethylene diamine tetracetates, N-hydroxy ethyl ethylene diamine triacetates, nitrilo-tri-acetates, ethylenediamine tetraproprionates, triethylene tetraamine hexacetates, diethylene triamine pentaacetates, and ethanol diglycines, alkali metal, ammonium, and substituted ammonium salts therein and mixtures therein.

Amino phosphonates are also suitable for use as chelating agents in the compositions of the invention when at least low levels of total phosphorus are permitted in detergent compositions, and include ethylene diamine tetrakis (methylene phosphonates) as DEQUEST®. Preferred, these amino phosphonates to not contain alkyl or alkenyl groups with more than 6 carbon atoms. Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene. A preferred biodegradable chelator for use herein is ethylenediamine disuccinate ("EDDS"), especially the [S,S] isomer as described in U.S. Pat. No. 4,704,233, Nov. 3, 1987, to Hartman and Perkins. The compositions herein may also contain water-soluble methyl glycine diacetic acid (MGDA) salts (or acid form) as a chelant or co-builder. Similarly, the so called "weak" builders such as citrate can also be used as chelating agents.

If utilized, these chelating agents will generally comprise from 0.00015% to 15% by weight of the detergent compositions herein. More preferably, if utilized, the chelating agents will comprise from 0.0003% to 3.0% by weight of such compositions.

Other Ingredients

The compositions will further preferably comprise one or more detersive adjuncts selected from the following: soil release polymers, polymeric dispersants, polysaccharides, abrasives, bactericides and other antimicrobials, tarnish inhibitors, dyes other than those discussed above, fluorescence dyes such as buffers, antifungal or mildew control agents, insect repellents, perfumes, thickeners, processing aids, suds boosters, brighteners, anti-corrosive aids, and stabilizers antioxidants. A wide variety of other ingredients useful in detergent compositions can be included in the compositions herein, including other active ingredients, carriers, antioxidants, processing aids, dyes or pigments, solvents for liquid formulations, solid fillers for bar compositions, etc. If high sudsing is desired, suds boosters such as the $C_{10}$-$C_{16}$ alkanolamides can be incorporated into the compositions, typically at 1%-10% levels. The $C_{10}$-$C_{14}$ monoethanol and diethanol amides illustrate a typical class of such suds boosters. Use of such suds boosters with high sudsing adjunct surfactants such as the amine oxides, betaines and sultaines noted above is also advantageous.

An antioxidant can be optionally added to the compositions of the present application. They can be any conventional antioxidant used in detergent compositions, such as 2,6-di-tert-butyl-4-methylphenol (BHT), carbamate, ascorbate, thiosulfate, monoethanolamine (MEA), diethanolamine, triethanolamine, etc. It is preferred that the antioxidant, when present, be present in the composition from 0.001% to 5% by weight.

Various detersive ingredients employed in the present compositions optionally can be further stabilized by absorbing said ingredients onto a porous hydrophobic substrate, then coating said substrate with a hydrophobic coating. Preferably, the detersive ingredient is admixed with a surfactant before being absorbed into the porous substrate. In use, the detersive ingredient is released from the substrate into the aqueous washing liquor, where it performs its intended detersive function.

To illustrate this technique in more detail, a porous hydrophobic silica (trademark SIPERNAT D10®, from DeGussa) is admixed with a proteolytic enzyme solution containing 3%-5% of $C_{13-15}$ ethoxylated alcohol (EO 7) nonionic surfactant. Typically, the enzyme/surfactant solution is 2.5× the weight of silica. The resulting powder is dispersed with stirring in silicone oil (various silicone oil viscosities in the range of 500-12,500 can be used). The resulting silicone oil dispersion is emulsified or otherwise added to the final detergent matrix. By this means, ingredients such as the aforementioned enzymes, bleaches, bleach activators, bleach catalysts, photoactivators, dyes, fluorescers, fabric conditioners and hydrolyzable surfactants can be "protected" for use in detergents, including liquid laundry detergent compositions.

Process of Cleaning Dishware

The present composition also relates to a process for cleaning dishware. The dishware is contacted with a composition as described above. The composition may be applied to the dishware neat or in dilute form. Thus the dishware may be cleaned by applying the composition to the dishware and optionally but preferably subsequently rinsing before drying. Alternatively, the composition can be mixed with water in a suitable vessel, for example a basin, sink or bowl and thus a number of dishes can be cleaned using the same composition and water (dishwater). In a further alternative process the product can be used in dilute form in a suitable vessel as a soaking medium for, typically extremely dirty, dishware. As before the dishware can be optionally, although preferably, rinsed before allowing to dry. Drying make take place passively by allowing for the natural evaporation of water or actively using any suitable drying equipment, for example a cloth or towel.

Viscosity Test Method

The viscosity of the detergent composition herein is measured on a Brookfield viscometer model # LVDVII+ at 20° C. The spindle used for these measurements is S31 with the appropriate speed to measure products of different viscosities; e.g., 12 rpm to measure products of viscosity greater than 1000 cps; 30 rpm to measure products with viscosities between 500 cps-1000 cps; 60 rpm to measure products with viscosities less than 500 cps.

The following examples, whilst being representative of the compositions of the present invention are in no way meant to be limiting.

TABLE 1

Liquid Dishwashing Detergent Composition

| Ingredient | Composition A Wt % | B Wt % | C Wt % | D Wt % |
|---|---|---|---|---|
| PLURONIC ® L81 | 0 | 1.0 | 0.5 | 0 |
| Poly(oxyethylene oxyhexylene) random co-polymer | 0 | 0 | 0 | 1.5 |
| Sodium Citrate•$2H_2O$ | 0 | 0 | 1.0 | 0 |
| SCS[1] | 1.8 | 0 | 0 | 0 |
| PolyPropylene Glycol 2000 | 0.8 | 0 | 0 | 0 |
| Ethanol | 2.5 | 2.0 | 2.8 | 2.5 |
| NaCl | 1.4 | 1.0 | 0.8 | 1.0 |
| Amine Oxide[2] | 6.0 | 6.0 | 6.5 | 6.5 |
| Nonionic[3] | 2.0 | 2.0 | 2.0 | 2.0 |
| Anionic (AE0.6S)[4] | 26.5 | 26.5 | 29 | 26.5 |
| 1,3 BAC[5] | 0.5 | 0.5 | 0.5 | 0.5 |

TABLE 1-continued

Liquid Dishwashing Detergent Composition

| Ingredient | Composition A Wt % | B Wt % | C Wt % | D Wt % |
|---|---|---|---|---|
| Suds boosting polymer[6] | 0.2 | 0.2 | 0.2 | 0.2 |
| enzyme[7] | 0.0001 to 5 | 0.0001 to 5 | 0.0001 to 5 | 0.0001 to 5 |
| Dye[8] | 0.001 to 0.5 | 0.001 to 0.5 | 0.001 to 0.5 | 0.001 to 0.5 |
| water to balance | balance | balance | balance | balance |
| pH @ 10% | 9 | 9 | 9 | 9 |

[1]Sodium Cumene Sulphonate
[2]$C_{12}$-$C_{14}$ Amine oxide.
[3]Nonionic may be either $C_{11}$ Alkyl ethoxylated surfactant containing 9 ethoxy groups or or $C_{10}$ Alkyl ethoxylated surfactant containing 8 ethoxy groups.
[4]$C_{12-13}$ alkyl ethoxy sulfonate containing an average of 0.6 ethoxy groups.
[5]1,3, BAC is 1,3 bis(methylamine)-cyclohexane.
[6](N,N-dimethylamino)ethyl methacrylate homopolymer
[7]such as protease. The protease is selected from: Savinase ®; Maxatase ®; Maxacal ®; Maxapem 15 ®; subtilisin BPN and BPN'; Protease B; Protease A; Protease D; Primase ®; Durazym ®; Opticlean ® and Optimase ®; and Alcalase ®.
[8]such as any of the metal complexing dyes in Formula A-I

TABLE 2

Hard Surface Cleaning Compositions

| | E wt % |
|---|---|
| $C_{11}$ alcohol ethoxylate (EO = 5) | 0.03 |
| Sodium $C_8$ Sulfonate | 0.01 |
| Propylene Glycol n-Butyl Ether | 2 |
| 2-Phenoxyethanol | 0.05 |
| Ethanol | 3 |
| Polyvinyl Pyridine N-Oxide (PVNO) | 0.015 |
| 2-Dimethylamino-2-methyl-2-propanol (DMAMP) | 0.01 |
| perfume | 0.01-0.06 |
| Suds suppressor[1] | 0.003 |
| Metal complexing dye[2] | 0.001 to 0.5 |
| Water and other minors | balance |

[1]such as Dow Corning AF Emulsion or polydimethyl siloxane
[2]such as any of the metal complexing dyes in Formula A-I

TABLE 3

Liquid Laundry Cleaning Composition

| Ingredients | F wt % |
|---|---|
| Linear alkylbenzenesulfonate | 10-15 |
| $C_{12-15}$ alcohol ethoxy$_{(1.1-2.5)}$ sulfate | 1-5 |
| $C_{12-13}$ alcohol ethoxylate $_{(7-9)}$ | 1-5 |
| cocodimethyl amine oxide | 0.1-1 |
| fatty acid | 1-5 |
| citric acid | 1-5 |
| Polymer a[1] | 0.1-1.5 |
| Polymer b[2] | 0.1-1.5 |
| Metal complexing dye[3] | 0.001 to 0.5 |
| hydroxylated castor oil (structurant) | 5-20 |
| Water, perfumes, dyes, and other trace components | balance |

[1]one or more polymers according to U.S. Pat. No. 4,891,160, VanderMeer, et al.
[2]one or more polymers according to WO 00/105923, Price, et al.
[3]such as any of the metal complexing dyes in Formula A-I.

TABLE 4

Low Sudsing Granular Laundry Cleaning Compositions

| | G wt % | H wt % | wt % |
|---|---|---|---|
| $C_{11-12}$ Linear alkyl benzene sulphonate | 7 | 5.1 | 10.2 |
| $C_{12-18\ (tallow)}$ alkyl sulfate | 1 | 1 | 1 |
| $C_{14-15}$ alkyl ethoxylate (EO = 7) | 3.2 | 3.2 | 3.2 |
| APA[1] | 0.94 | 0.68 | 1.36 |
| silicate builder[2] | 4.05 | — | — |
| Zeolite A[3] | 16.65 | — | — |
| Carbonate[4] | 14.04 | — | — |
| Citric Acid (Anhydrous) | 2.93 | 2.93 | 2.93 |
| acrylic acid/maleic acid copolymer[5] | 0.97 | 0.97 | 0.97 |
| Sodium carboxymethyl cellulose | 0.18 | 0.18 | 0.18 |
| Polymer[6] | 0.71 | 2.3 | 2.3 |
| Metal complexing dye[7] | 0.001 to 0.5 | 0.001 to 0.5 | 0.001 to 0.5 |
| Percarbonate | 12.8 | 16.18 | 13.25 |
| tetraacetylethylenediamine | 3.64 | 5.92 | 3.95 |
| 1-hydroxyethyidene-1,1-diphosphonic acid | 0.18 | 0.18 | 0.18 |
| S,S-(ethylenediamine N,N'-disuccinic acid) | 0.2 | 0.2 | 0.2 |
| $MgSO_4$ | 0.42 | 0.42 | 0.42 |
| ENZYMES[8] (% particle) | 1.26 | 1.26 | 1.26 |
| MINORS (perfume, dyes, suds stabilizers) | balance | balance | balance |

[1]$C_{8-10}$ amido propyl dimethyl amine

[2]Amorphous Sodium Silicate ($SiO_2$:$Na_2O$; 2.0 ratio)

[3]Hydrated Sodium Aluminosilicate of formula $Na_{12}(A10_2SiO_2)_{12}$•$27H_2O$ having a primary particle size in the range from 0.1 to 10 micrometers

[4]Anhydrous sodium carbonate with a particle size between 200 μm and 900 μm

[5]4:1 acrylic acid/maleic acid, average molecular weigh about 70,000 or 6:4 acrylic acid/maleic acid, average molecular weight about 10,000)

[6]U.S. Pat. No. 4,659,802, Rubingh et al. Example 2a:

[7]such as any of the metal complexing dyes in Formula A-I.

TABLE 4-continued

Low Sudsing Granular Laundry Cleaning Compositions

| | G wt % | H wt % | wt % |
|---|---|---|---|

[8]one or more enzymes such as: Protease - SAVINASE ®; by Novozyme or as described in WO 95/10591, sold by Genencor Int. Inc. Alcalase- as sold by NOVO Industries A/S Cellulase - as sold by NOVO Industries A/S under the tradename CAREZYME ®. Amylase - Amylolytic as sold by NOVO Industries A/S under the tradename TERMAMYL 120T ®; Amylolytic enzyme, as disclosed in PCT/US9703635 Lipase - Lipolytic enzyme, having 2.0% by weight of active enzyme, sold by NOVO Industries A/S under the tradename LIPOLASE ®; Lipolytic enzyme, having 2.0% by weight of active enzyme, sold by NOVO Industries A/S under the tradename LIPOLASE ULTRA ®. Endolase - Endoglucanase enzyme, having 1.5% by weight of active enzyme, sold by NOVO Industries A/S.

TABLE 5

Granular Laundry Cleaning Compositions

| | J wt % | K wt % | L wt % | M wt % |
|---|---|---|---|---|
| $C_{10-12}$ linear alkyl sulphonate | 15.0 | 17.5 | 12.7 | 12.7 |
| $C_{12-14}$ alkyl ethoxylate (EO = 7) | 1.8 | 1.8 | — | — |
| $C_{12-14}$ alkyl ethoxylate (EO = 9) | — | — | 3.8 | 3.0 |
| Builder[1] | 25.0 | — | — | — |
| Sequestrant[2] | — | 22.5 | — | — |
| enzyme | 0.35 | 0.40 | — | — |
| Polymer[3] | 0.75 | 1.0 | — | — |
| Metal complexing dye[4] | 0.001 to 0.5 | 0.001 to 0.5 | 0.001 to 0.5 | 0.001 to 0.5 |
| Carboxy Methyl Cellulose | 0.2 | 0.2 | 0.5 | 0.5 |
| suds suppressor[5] | 0.01 | 0.01 | — | — |
| Polyacrylate[6] | 0.80 | 1.0 | 0.5 | 0.5 |
| buffer | 4.0 | 2.0 | 6.0 | 6.0 |
| Carbonate | 11.0 | 15.0 | 8.0 | 8.0 |
| brightener | 0.08 | 0.08 | 0.03 | 0.03 |
| Sodium Sulfate | 34.83 | 32.33 | 65.09 | 65.09 |
| Minors, dyes, perfumes, water | balance | balance | balance | balance |

[1]sodium tripolyphosphate

[2]Zeolite A: Hydrated Sodium Aluminosilicate of formula $Na_{12}(A10_2SiO_2)_{12}$•$27H_2O$ having a primary particle size in the range from 0.1 to 10 micrometers

[3]A polymer according to U.S. Pat. No. 4,661,288,

[4]such as any of the metal complexing dyes in Formula A-I

[5]suds suppressor

[6]Mw = 4500

TABLE 6

Liquid Rinse Added Compositions

| INGREDIENTS | N wt % | O wt % | P wt % | Q wt % | R wt % | S wt % | T wt % |
|---|---|---|---|---|---|---|---|
| Fabric Softening Active[1] | 18.51 | 14-14.5 | — | 24.70 | 14 | 21 | — |
| Fabric Softening Active[2] | — | — | 18.00 | — | — | — | 12-35 |
| Fabric Softening Active[3] | — | — | 3.00 | — | 2 | — | 0-7 |
| Cationic Starch[4] | 0.84-2.52 | 1.68 | 1.68 | — | — | 0-1.68 | — |
| Perfume | 1.28-1.58 | 1-2 | 1.30 | 1-2 | 1-2 | 1-2 | 1-3 |
| TMPD[5] | — | — | 5.00 | — | — | — | 2-10 |
| NEODOL ® 91-8[6] | — | — | 2.15 | — | — | — | 4-6.6 |
| PLURONIC ® L35[7] | — | — | 1.5-2.0 | — | — | — | 1-2 |
| Phase Stabilizing Polymer[8] | 0.25 | 0.25 | — | 0.25 | 0.25 | 0.25 | — |
| Calcium Chloride | 0.55 | 0.55 | — | — | — | — | — |
| Magnesium Chloride | — | — | 2.00 | — | — | — | 2-2.2 |
| DTPA[9] | 0.01 | 0.01 | 0.20 | — | — | — | 0.02 |
| Preservative[10] | 7.5 ppm | 7.5 ppm | — | — | — | — | — |
| Antifoam[11] | 0.01 | 0.01 | — | — | — | — | — |

TABLE 6-continued

| INGREDIENTS | N wt % | O wt % | P wt % | Q wt % | R wt % | S wt % | T wt % |
|---|---|---|---|---|---|---|---|
| | Liquid Rinse Added Compositions | | | | | | |
| Dye | 22 ppm | 22 ppm | 11 ppm | 22 ppm | 22 ppm | 11-22 ppm | — |
| Metal complexing dye[14] | 0.001 to 0.5 | 0.001 to 0.5 | 0.001 to 0.5 | 0.001 to 0.5 | 0.001 to 0.5 | 0.001 to 0.5 | 0.001 to 0.5 |
| Ammonium Chloride | 0.1-0.3 | 0.1-0.3 | — | 0.10 | 0.10 | 0.10 | — |
| Hydrochloric Acid | — | — | 0-0.02 | — | — | — | 0.02 |
| Deionized Water | Balance | Balance | Balance | Balance | Balance | Balance | Balance |

[1]N,N-di(tallowoyloxyethyl)-N,N-dimethylammonium chloride.
[2]N,N-di(canola-oyloxyethyl)-N,N-dimethylammonium chloride.
[3]Methyl bis(tallow amidoethyl)2-hydroxyethyl ammonium methyl sulfate.
[4]Cationic starch based on common maize starch or potato starch, containing 25% to 95% amylose and a degree of substitution of from 0.02 to 0.09. Available from Cerestar under the trade name C*BOND ® and National Starch under the trade name CATO ® A2.
[5]2,2,4-trimethyl-1,3-pentanediol.
[6]C9-C11 alkyl polyethylene oxide having nine EO groups.
[7]Polyoxypropylene-polyoxyethylene block copolymer with MW approx. = 2000.
[8]Copolymer of ethylene oxide and terephthalate having the formula described in U.S. Pat. No. 5,574,179 at col. 15, lines 1-5, wherein each X is methyl, each n is 40, u is 4, each $R^1$ is essentially 1,4-phenylene moieties, each $R^2$ is essentially ethylene, 1,2-propylene moieties, or mixtures thereof.
[9]Diethylenetriaminepentaacetic acid.
[10]KATHON ® CG available from Rohm and Haas Co.
[11]Silicone antifoam agent available from Dow Corning Corp. under the trade name DC2310.
[12]Diethylenetriamine penta(methylene phosphonic acid).
[13]2-Phosphonobutane-1,2,4-tricarboxylic acid.
[14]such as any of the metal complexing dyes in Formula A-I While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A composition comprising an effective metal-complexing dye in an uncomplexed form and from about 0.1 wt % to about 40 wt % of a surfactant, wherein the metal complexing dye is formula (A)

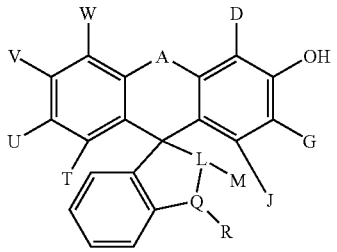

wherein A is two hydrogens on the respective ring structures; D is selected from hydrogen, —$CH_3$ or —$CH(CH_3)_2$; G is —$CH_2N(CH2COOH)_2$; J is selected from hydrogen or —$CH_3$; -L-M is O; Q-R is —C═O; T is selected from hydrogen or —$CH_3$; U is —$CH_2N(CH_2COOH)_2$; V is —OH; W is selected from hydrogen, —$CH_3$ or $CH(—CH_3)_2$.

2. The composition of claim 1 wherein the metal-complexing dye complexes with alkaline earth metal ions, rare earth metal ions, transition metal ions and mixtures thereof.

3. The composition of claim 1 wherein the metal complexing dye complexes with a metal ion selected from calcium, magnesium or iron.

4. The composition of claim 2 wherein the metal-complexing dye when complexed with the metal ions gives a visual indication.

5. The composition of claim 3 wherein the visual indication is a color change is characterized by a solution absorption wavelength of λmax=500 to 650 nm.

6. The composition of claim 1 wherein the composition is dissolved in a volume of water.

7. The composition of claim 1 wherein the surfactant is selected from the group consisting of:

(a) from about 0.1% to about 40% by weight of the compositing of an amine oxide;

(b) from about 10% to about 40% by weight of the composition of a $C_{10}$-$C_{20}$ alkyl or hydroxyalkyl sulphate or sulphonates;

(c) from about 0.1% to about 40% by weight of the composition of a nonionic surfactant;

(d) from about 0.1% to about 40% by weight of the composition of a cationic surfactant; or (e) mixtures thereof.

8. The composition of claim 1 wherein the composition is a liquid detergent composition further comprising from 30% to 80% by weight of the liquid detergent composition of an aqueous liquid carrier.

9. The composition of claim 1 wherein the composition comprises from 0.001% to 0.5% by weight of the composition of the metal-complexing dye.

10. The composition of claim 9 wherein the composition comprises from 0.001% to 0.2% by weight of the composition of a metal-complexing dye.

11. The composition of claim 1 further comprising a fluorescence dye, brighteners, and mixtures thereof.

* * * * *